US010369580B2

(12) United States Patent
Bailey et al.

(10) Patent No.: US 10,369,580 B2
(45) Date of Patent: Aug. 6, 2019

(54) BATTERY OPERATED DISPENSER

(71) Applicant: WestRock Dispensing Systems, Inc., Richmond, VA (US)

(72) Inventors: Ryan A. Bailey, Richmond, VA (US); Bryan K. Fields, Overland Park, KS (US); William L. Driskell, Lee's Summit, MO (US); Linn D. Wanbaugh, Blue Springs, MO (US); Connie Tran, Glen Allen, VA (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 278 days.

(21) Appl. No.: 15/101,192

(22) PCT Filed: Dec. 9, 2014

(86) PCT No.: PCT/US2014/069327

§ 371 (c)(1),
(2) Date: Jun. 2, 2016

(87) PCT Pub. No.: WO2015/089061

PCT Pub. Date: Jun. 18, 2015

(65) Prior Publication Data

US 2016/0296956 A1 Oct. 13, 2016

Related U.S. Application Data

(60) Provisional application No. 61/914,105, filed on Dec. 10, 2013.

(51) Int. Cl.

| | |
|---|---|
| ***B05B 9/08*** | (2006.01) |
| ***B05B 9/01*** | (2006.01) |
| ***B05B 12/00*** | (2018.01) |

(52) U.S. Cl.

CPC ..... *B05B 9/0861* (2013.01); *B05B 9/01* (2013.01); *B05B 9/0855* (2013.01); *B05B 12/002* (2013.01)

(58) Field of Classification Search

CPC ..... B05B 9/01; B05B 12/002; B05B 9/0855; B05B 9/0861; B01F 5/0413

USPC ..... 239/351, 349, 525–532, 375

See application file for complete search history.

(56) References Cited

U.S. PATENT DOCUMENTS

| | | | | |
|---|---|---|---|---|
| 5,947,386 | A * | 9/1999 | Dick | A01G 25/00 239/201 |
| 6,032,922 | A | 3/2000 | Shew | |
| 6,554,211 | B1 | 4/2003 | Prueter et al. | |
| 7,648,083 | B2 | 1/2010 | Hornsby et al. | |
| 2005/0194467 | A1 * | 9/2005 | Wanbaugh | B05B 9/0861 239/333 |
| 2010/0163646 | A1 | 7/2010 | Havlovitz et al. | |

* cited by examiner

*Primary Examiner* — Arthur O. Hall
*Assistant Examiner* — Tuongminh N Pham
(74) *Attorney, Agent, or Firm* — Barlow, Josephs & Holmes, Ltd.

(57) ABSTRACT

A battery operated dispenser includes a shell with a moveable slider for extending a barrel of the dispenser to allow targeted application of a fluid or product from a container to which the dispenser is attached.

6 Claims, 7 Drawing Sheets

BATTERY OPERATED DISPENSER

BACKGROUND OF THE INVENTION

Field of the Invention

Embodiments of the invention relate to battery operated trigger sprayers and more particularly to battery operated trigger sprayers having an extendable mechanism for distribution of a product.

State of the Art

Battery operated trigger sprayers are well known and may be found on many different products. In the home and garden industry—and especially with lawn care and pest control products—battery operated trigger sprayers are used to dispense products in targeted locals with relative ease of use. For example, many lawn care products include a battery operated trigger sprayer whereby a user may actuate a trigger to dispense a product through a dispenser. The dispenser includes a motor powered by one or more batteries and may be used to dispense a product.

Many battery operated trigger sprayers include a dispenser with a trigger connected to a container of product by a hose or tube. In this manner, the product container may be carried in one hand and the dispenser or battery operated sprayer may be used with a second hand.

While many different types of battery operated sprayers exist, there is a need to develop improved battery operated sprayers and better devices for delivering products through a battery operated sprayer in ergonomic fashion and with easier use.

BRIEF SUMMARY OF THE INVENTION

According to certain embodiments of the invention, a dispenser includes a shell having a motor contained therein which drives a pumping mechanism. In various embodiments of the invention, the shell may include a pistol or gun shape. A hose may connect the shell—or the pump chamber in the shell—to a container holding a product. The motor may be powered by one or more batteries—such as rechargeable or alkaline batteries—which may be contained within the shell of the dispenser. A pump chamber controlled by the motor may also be fluidly connected to a nozzle from which a product may be dispensed from the dispenser.

According to various embodiments of the invention, the dispenser may include an extendable barrel that may be moved from a "short" position wherein a portion of the barrel is contained within the shell to one or more "extended" positions wherein a portion of the barrel is extended outside the shell of the dispenser. In various embodiments, the shell may support a slider attachment which may be slid along a barrel of the shell to extend a smaller, internal barrel out the end of the shell, effectively extending the barrel of the shell. The slider may be configured to stop at various positions along the shell. The slider may also be used to retract the smaller, internal barrel back into the shell of the dispenser.

BRIEF DESCRIPTION OF THE DRAWINGS

Various embodiments of the invention can be more readily understood and appreciated by one of ordinary skill in the art from the following descriptions of various embodiments of the invention when read in conjunction with the accompanying drawings in which.

DETAILED DESCRIPTION OF THE INVENTION

Figure 1:
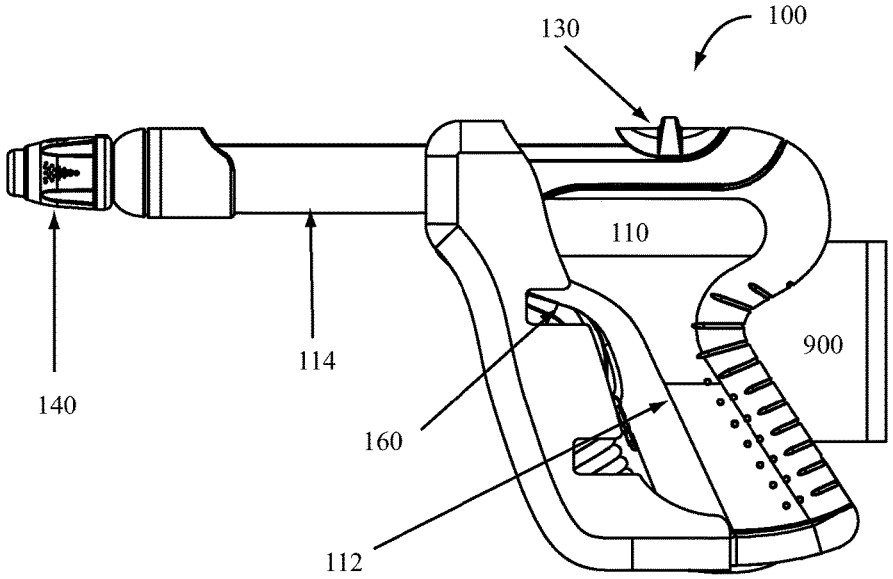
FIG. 1 illustrates a side view of a dispenser according to various embodiments of the invention with a holster.

According to various embodiments of the invention, a battery operated dispenser 100 may include a shell 110 enclosing a motor/pump assembly 200, a battery housing 210, wire connectors, a valve assembly 220, an extension barrel 120 an extension barrel slider adapter 125, pump extension tubing 128 and other components and connections to retain the shell 110 as a contiguous unit. The dispenser 100 may also include a nozzle assembly 141, a trigger 160, a hose 195, a hose connector 197, and a slider 130.

Figure 2:
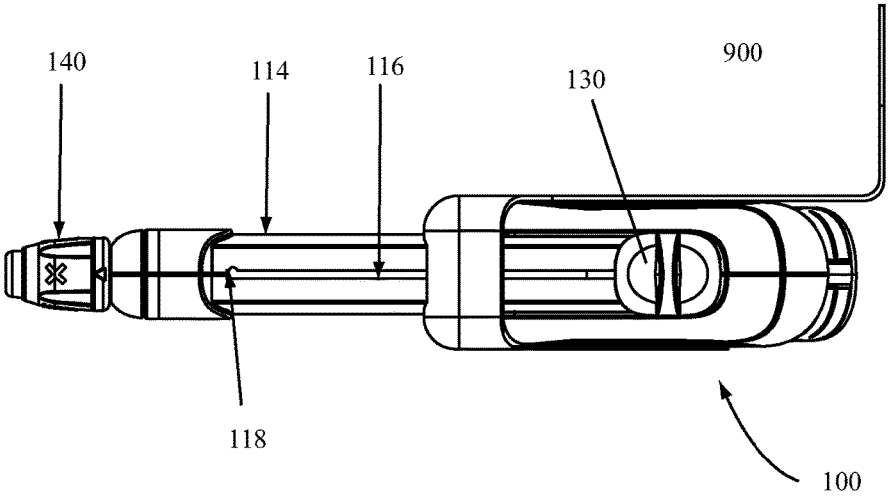
FIG. 2 illustrates a top down view of a dispenser according to various embodiments of the invention with a holster.

A dispenser 100 according to certain embodiments of the invention is illustrated in FIGS. 1 and 2 assembled with a holster 900 for removeably attaching the dispenser 100 to a container (not shown). For example, the holster 900 illustrated in FIG. 1 may be hung on a container or around an opening in a container such that the holster 900 and dispenser 100 may be connected to the container and sold with the container containing a product. In order to use the dispenser 100, a user may disengage the dispenser 100 from the holster 900, plug a hose connector 197 attached to the dispenser 100 into a container connector, extend the hose 195 between the container and dispenser 100, and actuate the trigger 160 of the dispenser 100 to dispense product from the container, through the dispenser 100 and out the nozzle 140.

Figure 3:
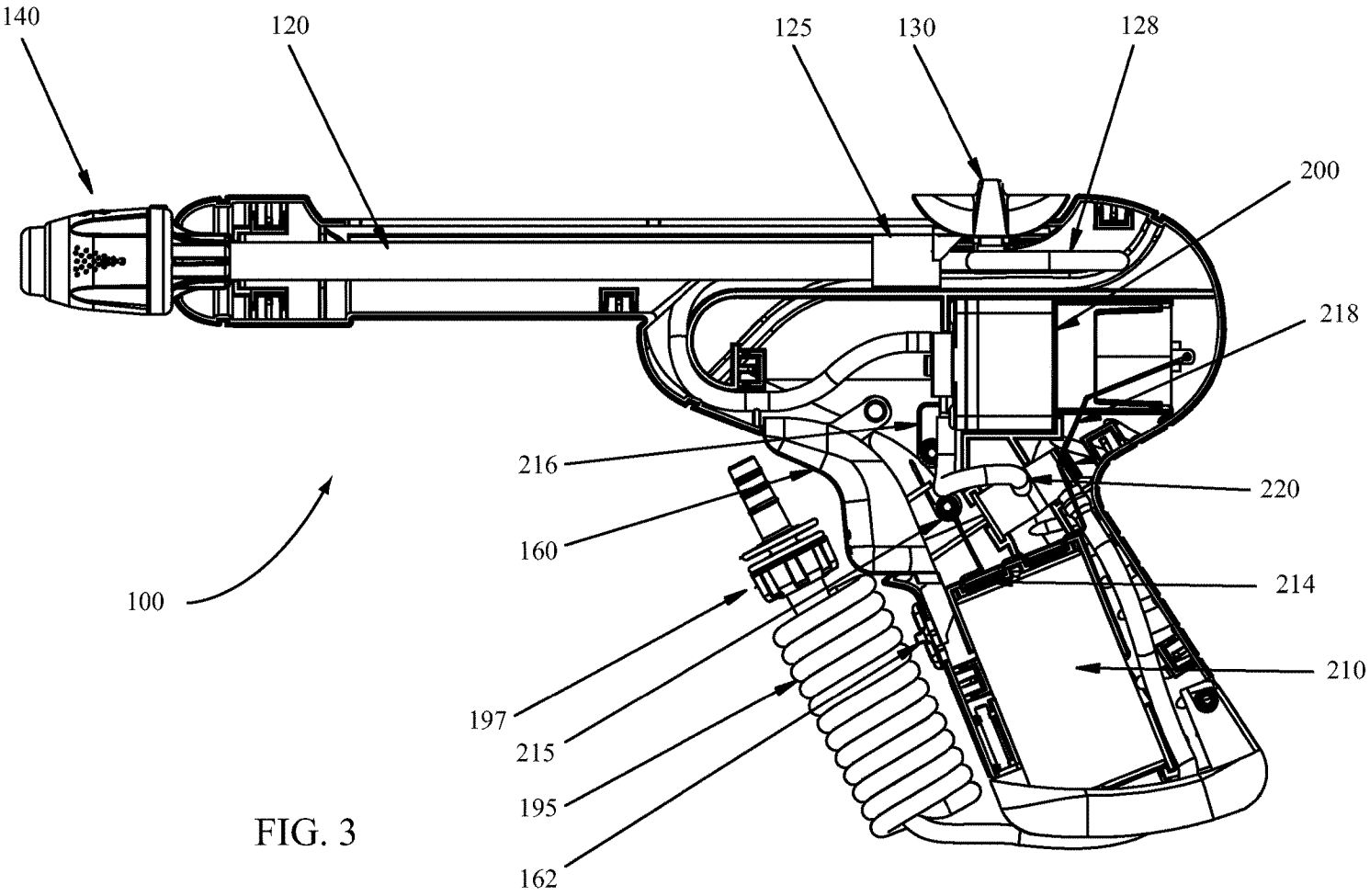
FIG. 3 illustrates a side, cross-sectional view of a dispenser according to various embodiments of the invention.

As illustrated in FIGS. 1 and 2, a dispenser 100 according to certain embodiments of the invention may include a slider 130. The slider 130 may be attached to or in communication with an extension barrel slider adapter 125 as illustrated in FIG. 3 or to an extension barrel 120. The slider 130 may move along a slider track 116 in a barrel 114 portion of the shell 110 of the dispenser 100. The slider track 116 may include one or more track stops 118 into which the slider 130 may lock or catch. The one or more track stops 118 may be configured to catch the slider 130 in a position as the slider 130 is moved along the slider track 116 of the barrel 114. In this manner, an extension barrel 120 may be extended out the end of the barrel 114 to increase the length of the dispenser 100 discharge portion. For instance, a user desiring a longer reach for the dispenser 100 may push on slider 130 and advance the slider 130 along the slider track 116, which movement extends the extension barrel 120 outside of the barrel 114, extending the overall length of that portion dispensing a product. A user may then retract the extension barrel 114 by moving the slider 130 back along the slider track 116 towards the grip 112 portion of the dispenser 100.

As illustrated, a dispenser 100 may have the general shape of a pistol or a gun. The shape may be generally defined by a two-part shell having both left and right sides that snap together, fit together or may otherwise be joined together to form the shell 110 of the dispenser 100. Upon assembly of the shell 110, a trigger 160 and a slider 130 may be positioned such that each part may move relative to the shell 110 when assembled.

A cross-sectional view of a dispenser 100 according to various embodiments of the invention is illustrated in FIG. 3. As illustrated, a dispenser 100 may include a shell 110 defining positioning for various parts of the dispenser 100. In some embodiments of the invention, an extension barrel 120 defining a flow path from one end to another end is moveably seated in the barrel 114 of the dispenser 100 and is connected to a nozzle 140 or nozzle assembly 141 at one end. At the opposite end, the extension barrel 120 may be connected to pump extension tubing 128. The extension barrel 120 may be fitted to an extension barrel slider adapter 125 which is also connected to a slider 130 such that movement of the slider 130 may move the extension barrel 120. An extension barrel 120 may be made of an extruded plastic material, a molded plastic material, or other material.

In some alternative embodiments of the invention, the pump extension tubing 128 may extend through the extension barrel 120 such that the pump extension tubing 128 may be connected to a nozzle assembly 141 at the other end of the extension barrel 120.

A motor/pump assembly 200 may be seated or secured in the shell 110 and connected to the pump extension tubing 128 on an exit end of the pump. The pump extension tubing 128 may snake through the shell 110 in such a manner—and with sufficient length—that the extension barrel 120 may be fully extended by a user.

An inlet portion of the motor/pump assembly 200 may be connected by hose or other fluid flow path to a valve assembly 220. The valve assembly 220 may control the flow of fluid through the valve assembly 220 and into the motor/pump assembly 200. The valve assembly 220 may also be in communication with a trigger 160 such that actuation of the trigger 160 may open a valve seated in the valve assembly 220, allowing product to pass therethrough and into the motor/pump assembly 200.

A trigger 160 may also be connected to—or able to contact and move—a wire contact battery switch 215 as illustrated in FIG. 3. The wire contact battery switch 215 may be connected to or in contact with a wire contact cross jumper 214 contacting one or more batteries. The wire contact battery switch 215 may also be bendable such that when trigger 160 is actuated, it contacts the wire contact battery switch 215 and moves it into contact with the wire contact motor switch 216. Upon contact of the wire contact battery switch 215 with the wire contact motor switch 216, a circuit may completed from the one or more batteries through the wire contact cross jumper 214, the wire contact battery switch 215, the wire contact motor switch 216, the motor/pump assembly 200 and the wire contact battery motor 218 back to the one or more batteries. In such a manner, power may be supplied to the motor/pump assembly 200 sufficient to pump a product from a container through the dispenser 100 and out the nozzle 140.

The valve assembly 220 may be connected to the hose 195 which may be connected to a container to provide a fluid flow path from a container to the dispenser 100.

A dispenser 100 may also include one or more locking features such as the lock button 162 illustrated in FIG. 3. The lock button 162 may lock the trigger 160 and prevent movement thereof, may disengage the wire contact cross jumper 214 from the one or more batteries preventing pumping of a product, or may both lock the trigger 160 and disengage electricity flow to the motor/pump assembly 200 to ensure that a dispenser 100 may not be inadvertently actuated.

Figure 4:
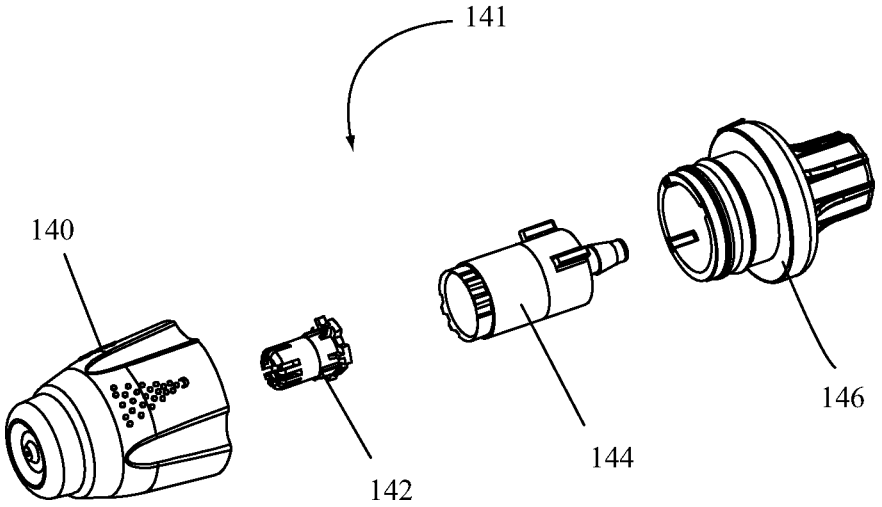
FIG. 4 illustrates a component view of a nozzle assembly for a dispenser according to various embodiments of the invention.

A nozzle assembly 141 according to various embodiments of the invention is illustrated in FIG. 4. As illustrated, a nozzle assembly 141 may include a nozzle 140, a spin mechanic stem 142, a stem adapter 144 and a nozzle extension adapter 146. In some embodiments of the invention, a spin mechanic stem 142 may mate with an interior of a nozzle 140 and may define the spin mechanics applied to a product or fluid being dispensed from the dispenser 100. A stem adapter 144 may mate with the nozzle 140 to hold the spin mechanic stem 142 in a desired position. The stem adapter 144 may also include at one end an adapter for mating with an extension barrel 120 or hose coming from—or through—the extension barrel 120. A nozzle extension adapter 146 may also mate with the nozzle 140, holding the stem adapter 144 within the nozzle 140 and providing an attachment for the extension barrel 120.

Figure 5:
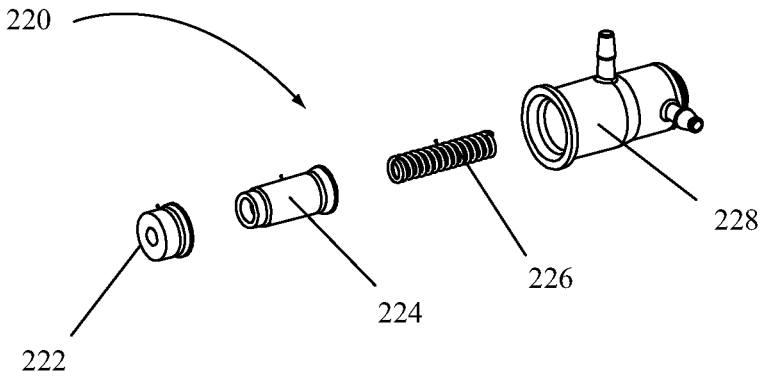
FIG. 5 illustrates a component view of a valve assembly for a dispenser according to various embodiments of the invention.

A valve assembly 220 according to various embodiments of the invention is illustrated in FIG. 5. As illustrated, a valve assembly 220 may include a valve manifold 228 into which a spring 226, product valve 224 and vent piston 222 may be inserted. The valve manifold 228 may also include an inlet barb and an outlet bard to which hose or other fluid conduit may be attached to deliver fluid or product to an interior of the valve manifold 228 and take or transport fluid or product out of or away from the valve manifold 228. For example, fluid may flow from a hose into the inlet barb and into an interior space of the valve manifold 228. Fluid being released from the valve manifold 228 may exit through the outlet barb and into a hose or other fluid conduit, which may be attached to the motor/pump assembly 200.

Figure 6:
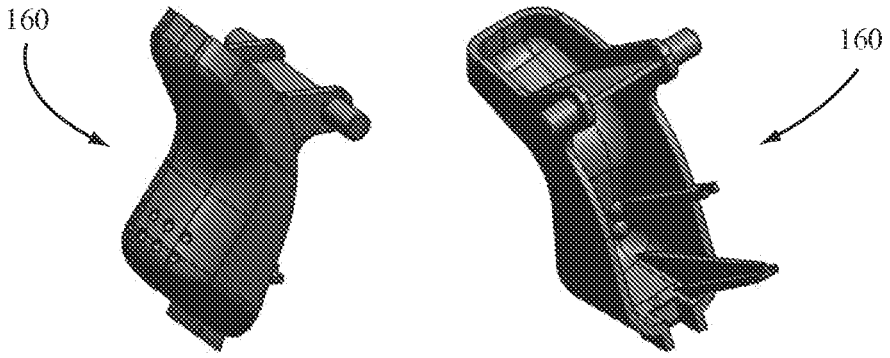
FIG. 6 illustrates a front-side perspective view and rear-side perspective view of a trigger according to various embodiments of the invention.
Figure 7:
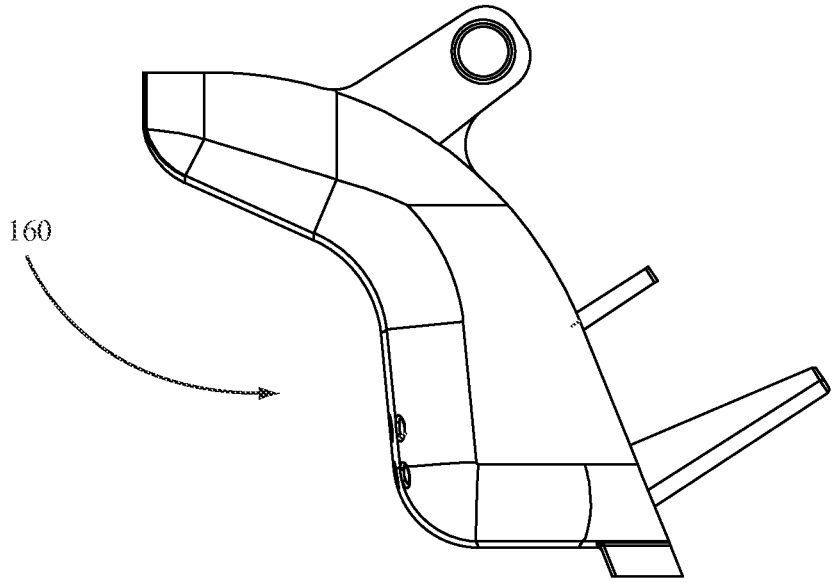
FIG. 7 illustrates a side view of a trigger according to various embodiments of the invention.

A trigger 160 according to some embodiments of the invention is illustrated in FIGS. 6 and 7. As illustrated, a trigger 160 may include one or more projections which may sit with opposite sides of a shell 110 such that the trigger 160 may be rotated or pivoted about the one or more projections. A trigger 160 may also include an actuation projection configured to mate with or act on a valve assembly 220. For example, as illustrated in FIG. 3, an actuation projection of the trigger 160 may interact with a vent piston 222 of the valve assembly 220 to push the vent piston 222 against the product valve 224 and move the spring 226, allowing fluid or product to flow through the valve manifold 228 to the motor/pump assembly 200. A trigger 160 may also include a wire projection which may interact with the wire contact battery switch 215 upon actuation of the trigger 160. The wire projection of the trigger 160 may push a wire contact battery switch 215 into a position where it touches—or makes electrical connection with—the wire contact motor switch 216.

Figure 8:
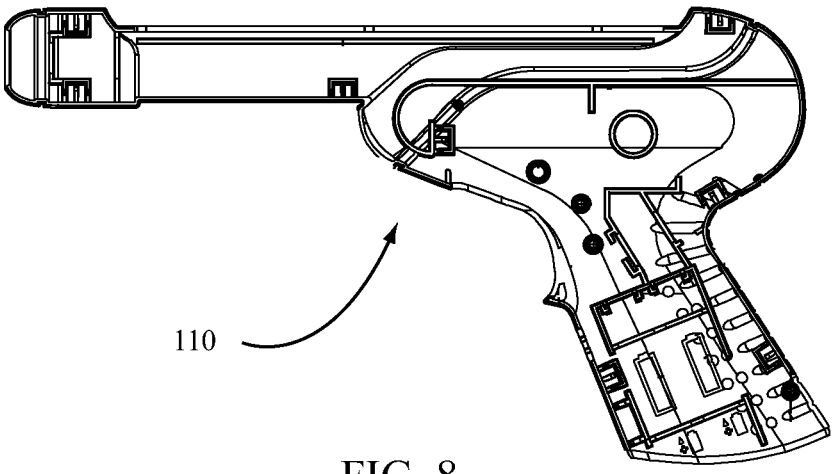
FIG. 8 illustrates an interior-side view of a shell of a dispenser according to various embodiments of the invention.
Figure 9:
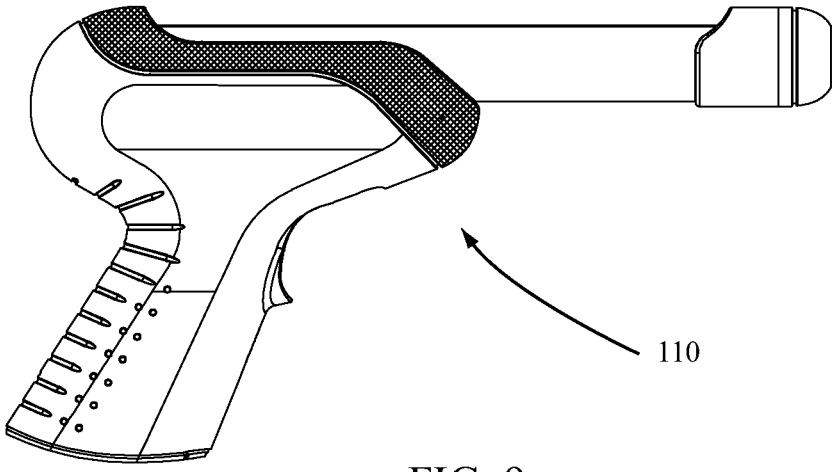
FIG. 9 illustrates an exterior-side view of a shell of a dispenser according to various embodiments of the invention.

A right side shell 110 piece of the dispenser 100 is illustrated in FIGS. 8 and 9. FIG. 8 illustrates the internal view of the right side shell 110 and FIG. 9 illustrates the external view of the right side shell 110. As illustrated in FIG. 8, the shell 110 may include different projections, compartments, guides, attachment points and other features to hold components of the dispenser 100 within the shell 110 for final assembly. In addition, a shell 110 according to various embodiments of the invention includes a tube or hose guide section configured to guide a length of pump extension tubing 128 through the shell 110. As illustrated in FIG. 3, the pump extension tubing 128 attached to the motor/pump assembly 200 snakes forward towards the outlet of the dispenser 100 along a path defined by the shell 110. The pump extension tubing 128 is then snaked backward, away from the outlet of the dispenser 100 along the path in the shell 110 to the point at which the pump extension tubing 128 again turns and connects with the extension barrel slider adapter 125 or the extension barrel 120, or where it is then guided through the extension barrel 120 to connect to the nozzle assembly 141. The path through the shell 110 allows the pump extension tubing 128 to move when the slider 130 extends the extension barrel 120 and guides the movement of the pump extension tubing 128 such that the pump extension tubing 128 does not become tangled, pinched or otherwise rendered inoperable during extension and retraction of the extension barrel 120.

Figure 10:
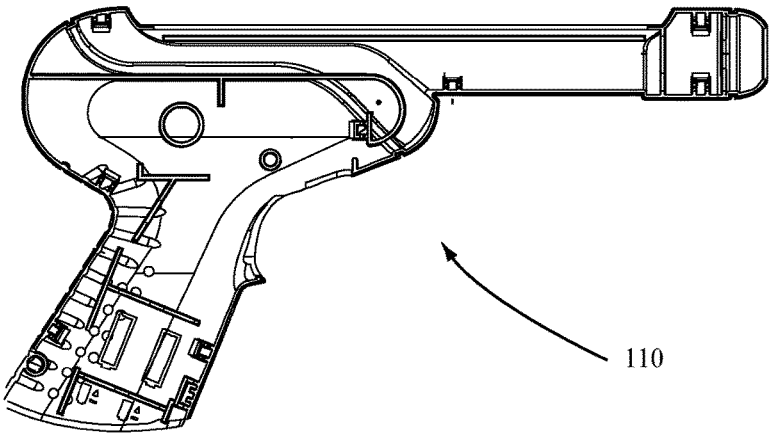
FIG. 10 illustrates an interior-side view of a shell of a dispenser according to various embodiments of the invention.
Figure 11:
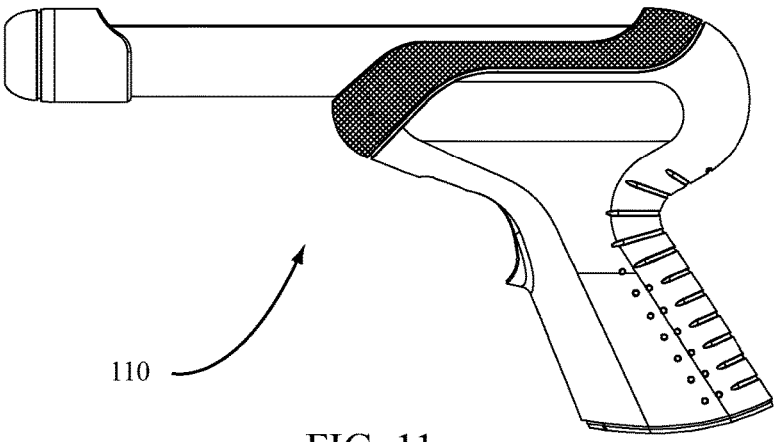
FIG. 11 illustrates an exterior-side view of a shell of a dispenser according to various embodiments of the invention.

A left side shell 110 piece of a dispenser 100 is illustrated in FIGS. 10 and 11. FIG. 10 illustrates the internal view of the left side shell 110 and FIG. 11 illustrates the external view of the left side shell 110. As illustrated in FIG. 10, the shell 110 may include different projections, compartments, guides, attachment points and other features to hold components of the dispenser 100 within the shell 110 for final assembly. In addition, a shell 110 according to various embodiments of the invention includes a tube or hose guide section configured to guide a length of pump extension tubing 128 through the shell 110. The tube or hose guide may be configured in one side of the shell 110 or may be partially defined in each side of the shell 110 such that the guide is fully formed when the right side of the shell 110 is combined with the left side of the shell 110.

Figure 12:
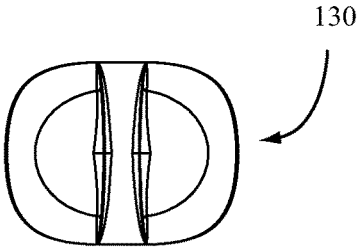
FIG. 12 illustrates a top-view of a slider for a dispenser according to various embodiments of the invention.
Figure 13:
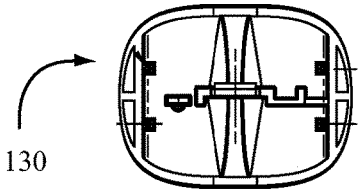
FIG. 13 illustrates a bottom-view of a slider for a dispenser according to various embodiments of the invention.
Figure 14:
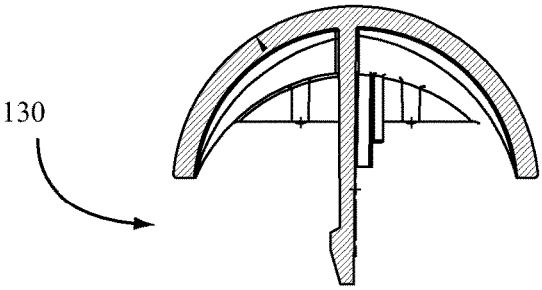
FIG. 14 illustrates a cross-sectional view of a slider for a dispenser according to various embodiments of the invention.

A slider 130 according to various embodiments of the invention is illustrated in FIGS. 12 through 14. FIG. 12 illustrates a top-down view of a slider 130, FIG. 13 illustrates a bottom view of a slider 130, and FIG. 14 illustrates a cross-sectional view of a slider 130. While the particular slider 130 illustrated has certain features for gripping and moving the slider 130 and for interacting with other parts of the dispenser 100, it is understood that any desired texture, grip features, or interaction features may incorporated with various embodiments of the invention. In some embodiments of the invention, a slider 130 may include features to guide it along a rail or slider track 116 in the barrel 114 of the shell 110. A slider 130 may also include a feature or features for stopping the slider 130 at a track stop 118 along a slider track 116. A slider 130 may also include a feature or features capable of interacting with an extension barrel slider adapter 125 or an extension barrel 120 to facilitate movement or extension and retraction of an extension barrel 120 of a dispenser 100.

Figure 15:
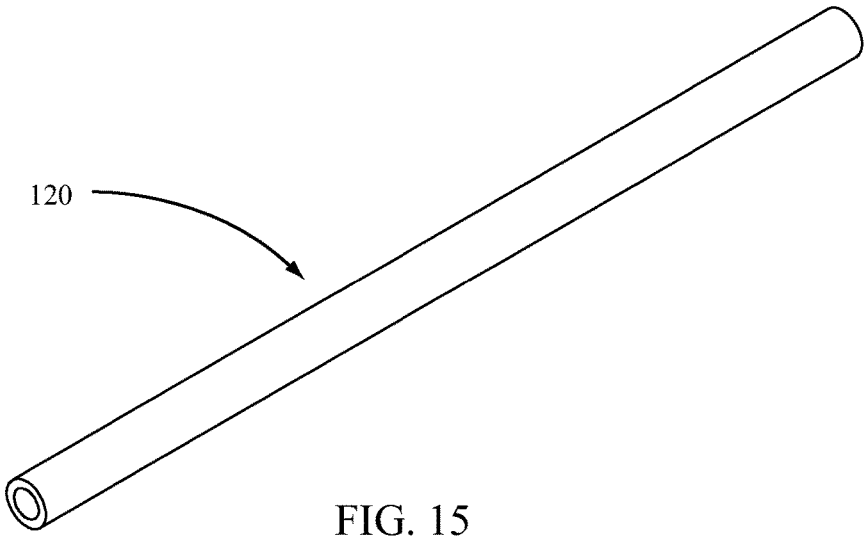
FIG. 15 illustrates a perspective view of an extension barrel for a dispenser according to various embodiments of the invention.

An extension barrel 120 according to certain embodiments of the invention is illustrated in FIG. 15. An extension barrel 120 may be used to guide a tube or the pump extension tubing 128 to a nozzle assembly 141 or may act as a fluid flow path between a pump extension tubing 128 attached at one end of the extension barrel 120 and the nozzle assembly 141 attached at an opposite end of the extension barrel 120. An extension barrel 120 may also include features to facilitate assembly of the extension barrel 120 with a shell 110, a nozzle assembly 141, an extension barrel slider adapter 125 or a slider 130.

In operation, a dispenser 100 as illustrated in the Figures may be detached from a holster—if a holster is used to hold the dispenser 100—and attached to a container holding a fluid or product for distribution. The connection between a container and the dispenser 100 may be a tube or other fluid conduit. The dispenser 100 may be pointed at the desired target—nozzle 140 aimed at the target—and the trigger 160 actuated or depressed. Actuation of the trigger 160 engages the motor/pump assembly 200, which pumps fluid or product from the container, through the various components of the dispenser 100 and out the nozzle 140. If a longer reach is desired, the slider 130 may be engaged and moved to extend the length of the barrel 114 by that portion of the extension barrel 120 desired. Track stops 118 may define fixed extension lengths but need not be used by an operator. When the extension barrel 120 is extended, the dispenser 100 operates in the same manner as when the extension barrel 120 is not extended. Upon completing application of a fluid or product, the trigger 160 may be released and any extension of the extension barrel 120 may be retracted by moving the slider 130. Furthermore, a lock button 162 may be engaged, moved, or positioned in a "lock" position to prevent actuation of the dispenser 100 or in an "unlocked" position, allowing the dispenser 100 to operate to deliver a fluid or product.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A dispenser, comprising:

a housing;

a valve assembly;

a hose connected to the valve assembly;

a battery compartment;

a trigger in communication with the valve assembly;

a motor/pump assembly;

a fluid flow path between the valve assembly and the motor/pump assembly;

a nozzle assembly;

a pump extension tube connected to the motor/pump assembly at a first end and in fluid communication with the nozzle assembly at a second end;

an extension barrel slidably retained within said housing, wherein in a first configuration the extension barrel is fully disposed within the housing and in a second configuration the extension barrel is at least partially disposed outside of the housing; and a slider in communication with the extension barrel, wherein the slider is fixed relative to the extension barrel and at least partially slidably retained in the housing in the first and second configurations, wherein the housing comprises a shell which encloses the valve assembly, motor/pump assembly, and pump extension tube; and wherein an extension barrel slider adapter is enclosed by the shell and connected to the slider and the extension barrel, wherein movement of the slider moves the extension barrel from the first configuration to the second configuration.

2. The dispenser of claim 1, wherein the pump extension tube is connected to the extension barrel at the second end and the extension barrel is connected to the nozzle assembly.

3. The dispenser of claim 1, wherein the shell is in the shape of a gun.

4. The dispenser of claim 1 wherein the valve assembly comprises:

a valve manifold defining an interior chamber;

an inlet barb defining a fluid flow path to the interior chamber;

an outlet barb defining a fluid flow path away from the interior chamber;

a spring in the interior chamber;

a product valve in contact with the spring in the interior chamber;

a vent piston in the interior chamber and in contact with the product valve; and wherein movement of the trigger moves the vent piston and product valve, allowing fluid to flow through the valve assembly.

5. The dispenser of claim 1, further comprising at least one battery in the battery compartment and wherein actuation of the trigger produces an electrical connection between the battery and the motor/pump assembly.

6. The dispenser of claim 1, wherein the pump extension tube extends through the extension barrel and-is connected to the nozzle.

* * * * *